US011316283B2

(12) United States Patent
Hwang et al.

(10) Patent No.: US 11,316,283 B2
(45) Date of Patent: Apr. 26, 2022

(54) DUAL POLARIZED ANTENNA

(71) Applicant: DELTA ELECTRONICS, INC., Taoyuan (TW)

(72) Inventors: Chieh-Tsao Hwang, Taoyuan (TW); Yen-Ting Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 16/904,521

(22) Filed: Jun. 17, 2020

(65) Prior Publication Data

US 2021/0028559 A1 Jan. 28, 2021

Related U.S. Application Data

(63) Continuation-in-part of application No. 16/568,867, filed on Sep. 12, 2019, now Pat. No. 11,197,366.

(30) Foreign Application Priority Data

Jul. 24, 2019 (CN) ..... 201910671907.3
Feb. 11, 2020 (CN) ..... 202010086565.1

(51) Int. Cl.
*H01Q 21/24* (2006.01)
*H01Q 9/04* (2006.01)
*H01Q 21/00* (2006.01)

(52) U.S. Cl.
CPC ..... *H01Q 21/24* (2013.01); *H01Q 9/0407* (2013.01); *H01Q 21/0006* (2013.01)

(58) Field of Classification Search
CPC ... H01Q 21/24; H01Q 9/0407; H01Q 21/0006
See application file for complete search history.

(56) References Cited

U.S. PATENT DOCUMENTS

| | | | | |
|---|---|---|---|---|
| 6,501,436 | B1 | 12/2002 | Saito et al. | |
| 10,014,572 | B2 | 7/2018 | Tagi et al. | |
| 10,326,196 | B2 | 6/2019 | Kim et al. | |
| 2003/0011522 | A1 | 1/2003 | McKinzie, III et al. | |
| 2014/0028524 | A1 | 1/2014 | Jerauld et al. | |
| 2014/0049437 | A1* | 2/2014 | Hung | H01Q 21/28 343/841 |
| 2014/0354513 | A1 | 12/2014 | Nair et al. | |
| 2015/0035714 | A1 | 2/2015 | Zhou | |

(Continued)

FOREIGN PATENT DOCUMENTS

| | | | |
|---|---|---|---|
| CN | 102823062 | B | 11/2014 |
| CN | 104157982 | A | 11/2014 |

(Continued)

*Primary Examiner* — Ankur Jain
*Assistant Examiner* — Angelica M Perez
(74) *Attorney, Agent, or Firm* — CKC & Partners Co., LLC

(57) ABSTRACT

A dual polarized antenna includes a first antenna unit and an isolated band gap. The first antenna unit is formed on the dielectric board, and the first antenna unit being conducted is configured to receive or transmit a signal with each of a first polarization direction and a second polarization direction. The isolated band gap is formed on the dielectric board and is disposed adjacent to the first antenna unit. It forms a first included angle which is neither 0° nor 90° between the first polarization direction and the isolated band gap.

19 Claims, 8 Drawing Sheets

(56) References Cited

U.S. PATENT DOCUMENTS

| | | | | |
|---|---|---|---|---|
| 2016/0028161 | A1* | 1/2016 | Kawaguchi | H01Q 1/32 343/700 MS |
| 2017/0317421 | A1 | 11/2017 | Grando et al. | |
| 2018/0241442 | A1 | 8/2018 | Zirwas et al. | |
| 2018/0270555 | A1* | 9/2018 | Mao | H04R 1/10 |
| 2019/0089069 | A1 | 3/2019 | Niroo et al. | |
| 2019/0098750 | A1 | 3/2019 | Woo | |
| 2019/0229398 | A1 | 7/2019 | Ryoo et al. | |
| 2020/0106188 | A1 | 4/2020 | Ou et al. | |

FOREIGN PATENT DOCUMENTS

| | | | |
|---|---|---|---|
| CN | 104157982 | * | 2/2016 |
| CN | 106329151 | A | 1/2017 |
| CN | 106329154 | A | 1/2017 |
| CN | 207732097 | U | 8/2018 |
| CN | 108886201 | A | 11/2018 |
| CN | 109904605 | A | 6/2019 |
| DE | 112017000954 | T5 | 11/2018 |
| DE | 112017001941 | T5 | 1/2019 |
| JP | 2008-283381 | A | 11/2008 |
| JP | 2014-39245 | A | 2/2014 |
| JP | 2014-179680 | A | 9/2014 |
| JP | 2014179680 | A1 | 9/2014 |
| TW | I473347 | B | 2/2015 |

* cited by examiner

DUAL POLARIZED ANTENNA

CROSS-REFERENCE TO RELATED APPLICATION

This present application is a continuation-in-part application of U.S. patent application Ser. No. 16/568,867, filed Sep. 12, 2019, which claims priority to China Application Serial Number 201910671907.3, filed Jul. 24, 2019, all of which are herein incorporated by reference. The present application claims priority to China Application Serial Number 202010086565.1, filed Feb. 11, 2020, which is herein incorporated by reference in its entirety.

BACKGROUND

Field of Invention

The present invention relates to the technical field of antennas. More particularly, the present invention relates to a dual polarized antenna with high isolation.

Description of Related Art

In recent years, various wireless communication technologies have developed rapidly, and the signal quality and transmission speed are required to be greater. In order to support a wider area network, many wireless communication products include an antenna to receive a signal from another electronic device or to transmit a signal to another electronic device. However, in multi-input multi-output applications of antennas, the antennas have low signal quality due to the low isolation between multiple signals.

SUMMARY

The present disclosure provides a dual polarized antenna comprising a first antenna unit and an isolated band gap. The first antenna unit is formed on the dielectric board, and the first antenna unit being conducted is configured to receive or transmit a signal with each of a first polarization direction and a second polarization direction. The isolated band gap is formed on the dielectric board and disposed adjacent to the first antenna unit. A first included angle which is neither 0° nor 90° is formed between the first polarization direction and the isolated band gap. The dual polarized antenna has good directivity and isolation.

The present disclosure provides a dual polarized antenna comprising an antenna array and a first isolated band gap. The antenna array is formed on the dielectric board, and the antenna array being conducted is configured to receive or transmit a signal with one of a first polarization direction or a second polarization direction. The first isolated band gap is formed on the dielectric board and disposed adjacent to the antenna array. An included angle which is neither 0° nor 90° is formed between the first polarization direction and the first isolated band gap. The dual polarized antenna has good directivity and isolation.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1B:
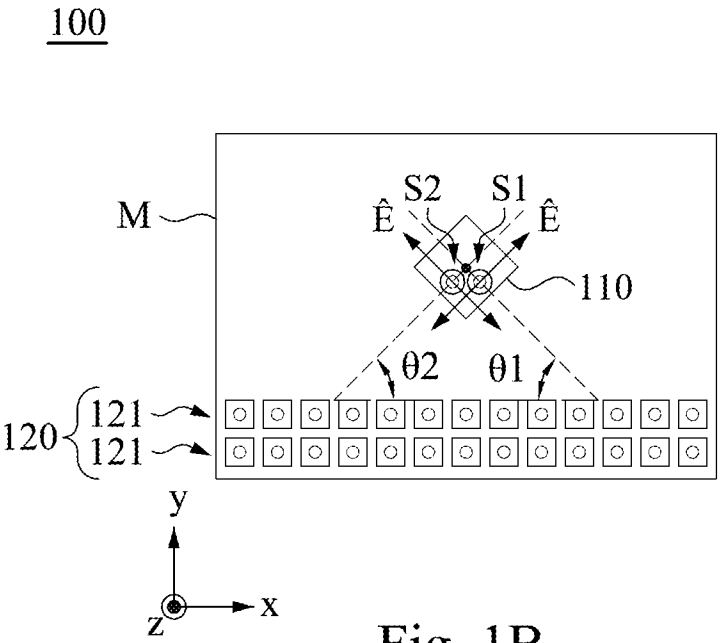
FIG. 1B is a schematic diagram of an operation of the dual polarized antenna according to FIG. 1A.

Reference will now be made in detail to the present embodiments of the invention, examples of which are illustrated in the accompanying drawings. Wherever possible, the same reference numbers are used in the drawings and the description to refer to the same or like parts.

In addition, the words "including", "comprising", "having", "containing", etc. used in this article are all open terms, meaning "including but not limited to. In addition, the "and/or" used in this article includes any one or more of the listed items and all combinations thereof.

In this article, when an element is referred to as "connected" or "coupled", it can be referred to as "electrically connected" or "electrically coupled." "Connected" or "coupled" can also be used to indicate the operation or interaction of two or more components. In addition, although terms such as "first", "second", etc. are used in this document to describe different elements, the terms are only used to distinguish elements or operations described in the same technical terms. Unless the context clearly dictates, the term does not specifically refer to or imply an order or order, nor is it intended to limit the present invention.

The comparative terms used in this article such as "lower", "bottom", "higher", "top", "left" or "right", etc., are only used to illustrate the implementation mentioned in this article Illustration in the example. In addition to the orientation of directions in the illustration, it also includes other relative orientation terms. For example, if the device is turned over in an illustration, the description between one component and another component may change from "lower" to "higher". Among them, the term "lower" may include two directions, "lower" and "higher", depending only on the orientation of the illustration. Similarly, if the device is turned over in an illustration, the description between one component and another component may change from "lower" or "below" to "upper". Terms such as "lower" or "below" can include two orientations in the up or down direction.

The terms "roughly", "about", "approximately" and the like described herein are generally expressed within a certain value or within 20% of the average, or preferably within 10%, or better within 5%. If the numerical values described in this article are approximate, it can be inferred that they refer to terms such as "about" and "approximately".

In various wireless communication products, an antenna is often used to achieve the function of signal transmission. In some applications, in order to increase the transmission distance of a signal, the product further includes a repeater with the antenna to adjust and amplify the signal. In some products, the antenna used in multi-input multi-output is implemented with a dual polarized antenna. Signals transmitted by the antenna may have crosstalk. Therefore, the antenna requires high isolation.

In some applications, a metal structure which is disposed adjacent to the antenna is configured to generate resonance with the signal of the antenna and to form a structure with high impedance to block the passage of electromagnetic waves with similar frequencies, to achieve the requirements of high isolation. However, the current metal structure and the structure of the antenna or the arrangement therebetween will completely block the signal transmission of the antenna. Especially, when the antenna is a dual polarized antenna, this defect is worse. In view of this, the present disclosure provides the dual polarized antenna with high isolation and directivity that overcomes this drawback.

In various embodiments of the present disclosure, the dual polarized antenna is constructed in a three-dimensional coordinate system and includes three mutually orthogonal coordinate axes x, y, and z. In some embodiments, the dual polarized antenna is constructed in other types of coordinate systems, and is not limited thereto.

Figure 1A:
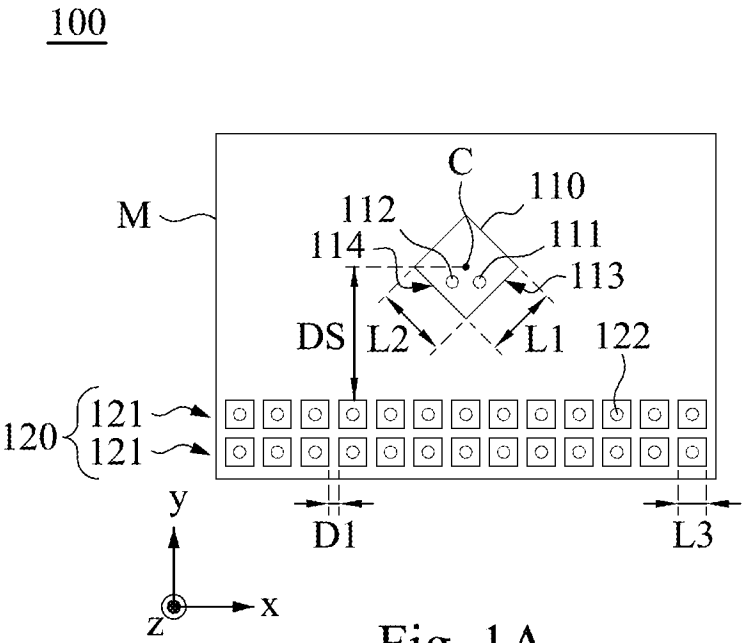
FIG. 1A is a schematic diagram of a dual polarized antenna according to an embodiment of the present disclosure.

FIG. 1A is a schematic diagram of a dual polarized antenna 100 according to an embodiment of the present disclosure, in which FIG. 1A is a top view diagram on an x-y plane.

The dual polarized antenna 100 includes an antenna unit 110 and an isolated band gap 120. Both the antenna unit 110 and the isolated band gap 120 are formed on a dielectric board M, and the antenna unit 110 and the isolated band gap 120 are disposed adjacently.

The antenna unit 110 is a patch antenna, which includes a first feed point 111 and a second feed point 112. Both the first feed point 111 and the second feed point 112 are coupled to another dielectric board (not shown) parallel to the dielectric board M, and are respectively used to feed signals to receive or transmit a signal with each of a horizontal polarization direction and a vertical polarization direction.

On the x-y plane, the antenna unit 110 has a parallelogram shape and includes a pair of first edges 113 having a first length L1 and a pair of second edges 114 having a second length L2. The first feed point 111 is disposed adjacent to one of the first edges 113 (as shown in FIG. 1A), and the second feed point 112 is disposed adjacent to one of the second edges 114 (as shown in FIG. 1A), in which the second edge 114 and the first edge 113 are adjacent edges.

In some embodiments, on the x-y plane, the first feed point 111 is disposed adjacent to the center point (not shown) of the first edge 113, and the second feed point 112 is disposed adjacent to a center point (not shown) of the second edge 114. In some embodiments, a distance (not shown) between a center point of the first edge 113 and the isolated band gap 120 and a distance (not shown) between a center point of the second edge 114 and the isolated band gap 120 are the same. In some embodiments, a distance (not shown) between the first feed point 111 and the isolated band gap 120 and a distance (not shown) between the second feed point 112 and the isolated band gap 120 are the same.

In some embodiments, the antenna unit 110 is square on the x-y plane. In some embodiments, on the x-y plane, the antenna unit 110 is diamond-shaped, and a shape of the antenna unit 110 relative to the x-y plane is not limited herein.

A distance (for example, the distance DS shown in FIG. 1A) between a center point C of the antenna unit 110 and the isolated band gap 120 is approximately in a range of 0.3 to 0.5 times a wavelength of an operating frequency of the antenna unit 110, i.e., $3\lambda/10 \leq$ distance DS $\leq \lambda/2$, in order to achieve a good isolation effect. In some embodiments, the distance between the center point C of the antenna unit 110 and the isolated band gap 120 is about 0.4 times the wavelength of the operating frequency of the antenna unit 110, i.e. $2\lambda/5$, in order to achieve better isolation.

The first length L1 of the first edge 113 and the second length L2 of the second edge 114 are both approximately equal to 0.25 times the wavelength of the operating frequency of the antenna unit 110, i.e. $\lambda/4$, in order to achieve good impedance matching and good directivity. In some embodiments, the first length L1 and the second length L2 are equal to each other.

The isolated band gap 120 includes a plurality of isolated structures 121. In some embodiments, the isolated band gap 120 is an electromagnetic band gap (EBG) to suppress surface waves on the x-y plane.

On the x-y plane, the isolated structures 121 are strip metal structures and are arranged adjacent to each other, and the isolated band gap 120 includes a pair of isolated structures. The isolated structure 121 includes a plurality of isolated units 122. On the x-y plane, the isolated units 122 are rectangular and arranged adjacent to each other. A number of isolated structures and a number or shape of the isolated units of the various embodiments in the present disclosure are merely illustrative, and are not limited herein.

The isolated unit 122 includes a top metal sheet (for example, a rectangle of the isolated unit 122 shown in FIG. 1A, not labeled) and a connection metal via (for example, a circle in the isolated unit 122 shown in FIG. 1A, Not shown). The top metal sheet is formed on the dielectric board M, and is coupled to the connection metal via. An end (not shown in FIG. 1A) of the connection metal via which is not connected to the top metal sheet is coupled to another board parallel to the dielectric board M, and is used to produce electromagnetic induction to form high-impedance characteristics and block the passage of signals with specific frequencies when the top metal sheet receives the signal of a specific frequency (for example, the operating frequency of the antenna unit 110). Therefore, the isolated band gap 120 can block some signals received or transmitted by the antenna unit 110, especially surface signals on the x-y plane, so as to improve the directivity of the antenna unit 110.

A length (for example, the length L3 of the side length shown in FIG. 1A) of the maximum side length of the isolated unit 122 is less than 0.1 times the wavelength of the operating frequency of the antenna unit 110, i.e. $\lambda/10$. A distance (for example, the interval distance D1 shown in FIG. 1A) of the isolated interval between the isolated units 122 is less than 0.02 times the wavelength of the operating frequency of the antenna unit 110, i.e. $\lambda/50$.

In some embodiments, on the x-y plane, the isolated units 122 are square, and the characteristics of the side lengths of the isolated units 122 and the characteristics of the gap between the isolated units 122 are as described above, and shapes of the isolated units 122 are not limited here.

In some embodiments, the isolated units 122 corresponds to the isolated unit 722 shown in FIGS. 7 and 8 and are described in more detail below.

The relative position of the dual polarized antenna 100 and the size of each unit can increase the front-to-back ratio (FtB ratio) of the radiation pattern of the signal, and can improve the signal transmission distance and the overall efficiency. In some embodiments, the operating frequency band of the dual polarized antenna 100 includes the operating frequency (corresponding to a frequency band of millimeter waves) between 27 GHz and 29 GHz, so the dual polarized antenna 100 can be applied to the fifth generation mobile communication technology (5th generation mobile networks, 5G).

Reference is made to FIG. 1B. FIG. 1B is a schematic diagram of the operation of the dual polarized antenna of FIG. 1A according to some embodiments of the present disclosure. For the sake of brevity of illustration and the convenience of understanding of present disclosure, FIG. 1B does not show some of same units as in FIG. 1A.

When the dual polarized antenna 100 operates, the signal is transmitted in the Z direction, and the signal with each of a horizontal polarization direction and a vertical polarization direction are simultaneously received or transmitted by the antenna unit 110. As shown in FIG. 1B, the signal S1 with the horizontal polarization direction is received or transmitted by the first feed point 111 (as show in FIG. 1A), and the signal S2 with the vertical polarization direction is also received or transmitted by the second feed point 112 (as shown in FIG. 1A).

A first included angle θ1 is formed between the horizontal polarized direction (for example, the electric field direction of the signal S1 shown in FIG. 1B) and the isolated band gap 120, and a second included angle θ2 is formed between the vertical polarized direction (for example, the electric field direction of the signal S2 shown in FIG. 1B) and the isolated band gap. A size of the first included angle θ1 and a size of the second included angle θ2 are neither 0° nor 90°. In this embodiment, it can also be understood that the horizontal polarized direction takes the x-axis as the reference axis and has a first included angle θ1 with the x-axis. The vertical polarized direction is based on the x-axis and has a second included angle θ2 with the x-axis.

In some embodiments, the size of the first included angle θ1 is in a range of 40° to 50°. In some embodiments, the size of the first included angle θ1 is equal to the size of the second included angle θ2. In some embodiments, the first included angle θ1 and the second included angle θ2 are complementary angles.

In this way, the dual polarized antenna 100 can simultaneously transmit two signals (for example, the signals S1 and S2 shown in FIG. 1B) with both of different polarization direction s, and these signals will not be blocked by the isolated band gap 120 to facilitate the signals to transmit to other signal processing ends. At the same time, the electromagnetic isolation of the isolated band gap 120 can block other noises, thereby increasing the isolation between the dual polarized antenna 100 and other communication units.

Figure 2:
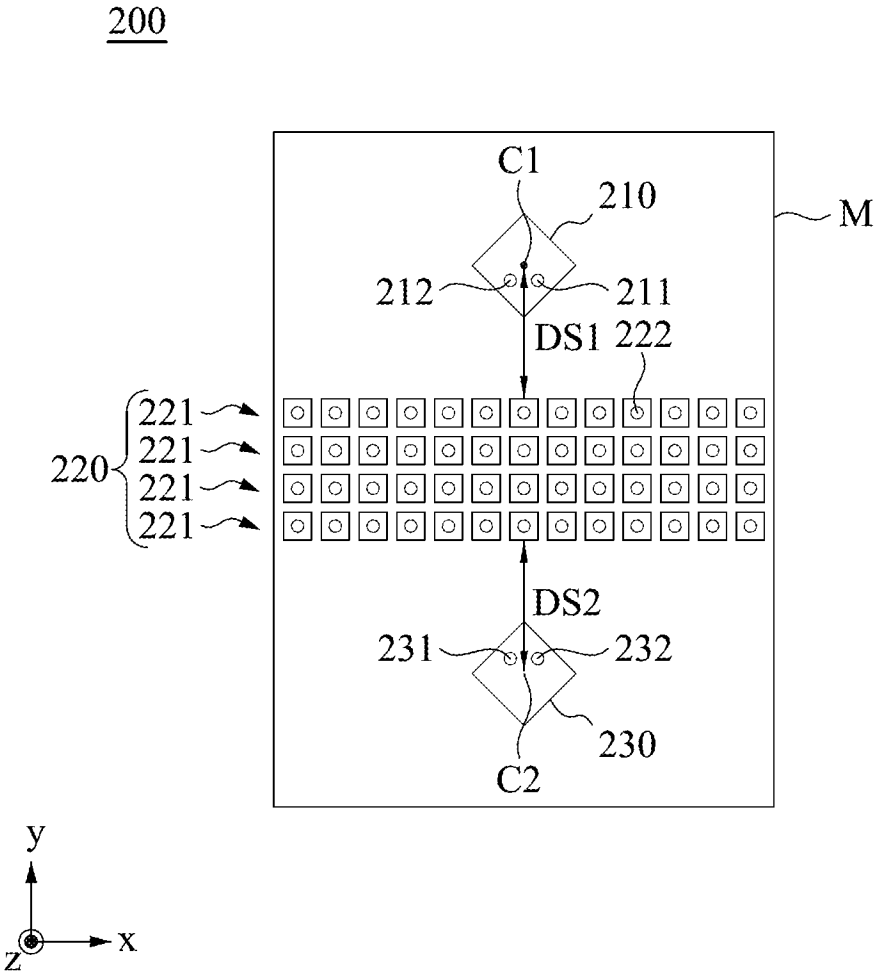
FIG. 2 is a schematic diagram of a dual polarized antenna according to an embodiment of the present disclosure.

FIG. 2 is a schematic diagram of a dual polarized antenna according to an embodiment of the present disclosure, in which FIG. 2 is a top view diagram on the x-y plane.

The dual polarized antenna 200 includes a first antenna unit 210, an isolated band gap 220, and a second antenna unit 230. The first antenna unit 210, the isolated band gap 220, and the second antenna unit 230 are all formed on the dielectric board M, and the isolated band gap 220 is disposed between the first antenna unit 210 and the second antenna unit 230 adjacently.

On the x-y plane, a minimum distance (for example, the distance DS1 shown in FIG. 2) between a center point C1 of the first antenna unit 210 and the isolated band gap 220 is approximately in a range of 0.3 to 0.5 times a wavelength of an operating frequency of the first antenna unit 210, i.e. $3\lambda/10 \leq$ distance DS1 $\leq \lambda/2$, in order to achieve a good isolation effect. In some embodiments, a distance between the center point C1 of the first antenna unit 210 and the isolated band gap 220 is about 0.4 times the wavelength of the operating frequency of the first antenna unit 210, i.e. $2\lambda/5$, in order to achieve a better isolation effect.

Similarly, a minimum distance (for example, the distance DS2 shown in FIG. 2) between the center point C2 of the second antenna unit 230 and the isolated band gap 220 is about in a range of 0.3 to 0.5 times the wavelength of the operating frequency of the second antenna unit 230, i.e. $3\lambda/10 \leq$ distance DS2 $\leq \lambda/2$, in order to achieve a good isolation effect. In some embodiments, a distance between the center point C2 of the second antenna unit 230 and the isolated band gap 220 is approximately 0.4 times the wavelength of the operating frequency of the second antenna unit 230, i.e. $2\lambda/5$, in order to achieve more better isolation effect.

In some embodiments, the first antenna unit 210 and the second antenna unit 230 have the same antenna structure, and are similar to the antenna unit 110 shown in FIG. 1, and thus the same points are not described herein.

In some embodiments, the first antenna unit 210 and the second antenna unit 230 are symmetrical with the center of the isolated band gap 220 as the axis of symmetry. Therefore, the minimum distance between the center point C1 of the first antenna unit 210 and the isolated band gap 220 is equal to the minimum distance between the center point C2 of the second antenna unit 230 and the isolated band gap 220. In other words, the distance DS1 is the same as the distance DS2. In addition, a first feed point 211 of the first antenna unit 210 corresponds to the first feed point 231 of the second antenna unit 230, and a second feed point 212 of the first antenna unit 210 corresponds to a second feed point 232 of the second antenna unit 230.

The isolated band gap 220 includes a plurality of isolated structures 221, and each isolated structure 221 includes a plurality of isolated units 222, and the isolated band gap 220, the isolated structures 221 and the isolated units 222 are respectively similar to the isolated band gap 120, the isolated structure 121, and the isolated units 122 shown in FIG. 1.

The isolated band gap includes two pairs of isolated structures 221, i.e. four isolated structures 221. When there are more isolated structures 221, the isolation of the dual polarized antenna 200 is greater. Therefore, with the isolated band gap 220 having two pairs of isolated structures 221, the first antenna unit 210 and the second antenna unit 230 do not affect each other during operation.

Figure 3:
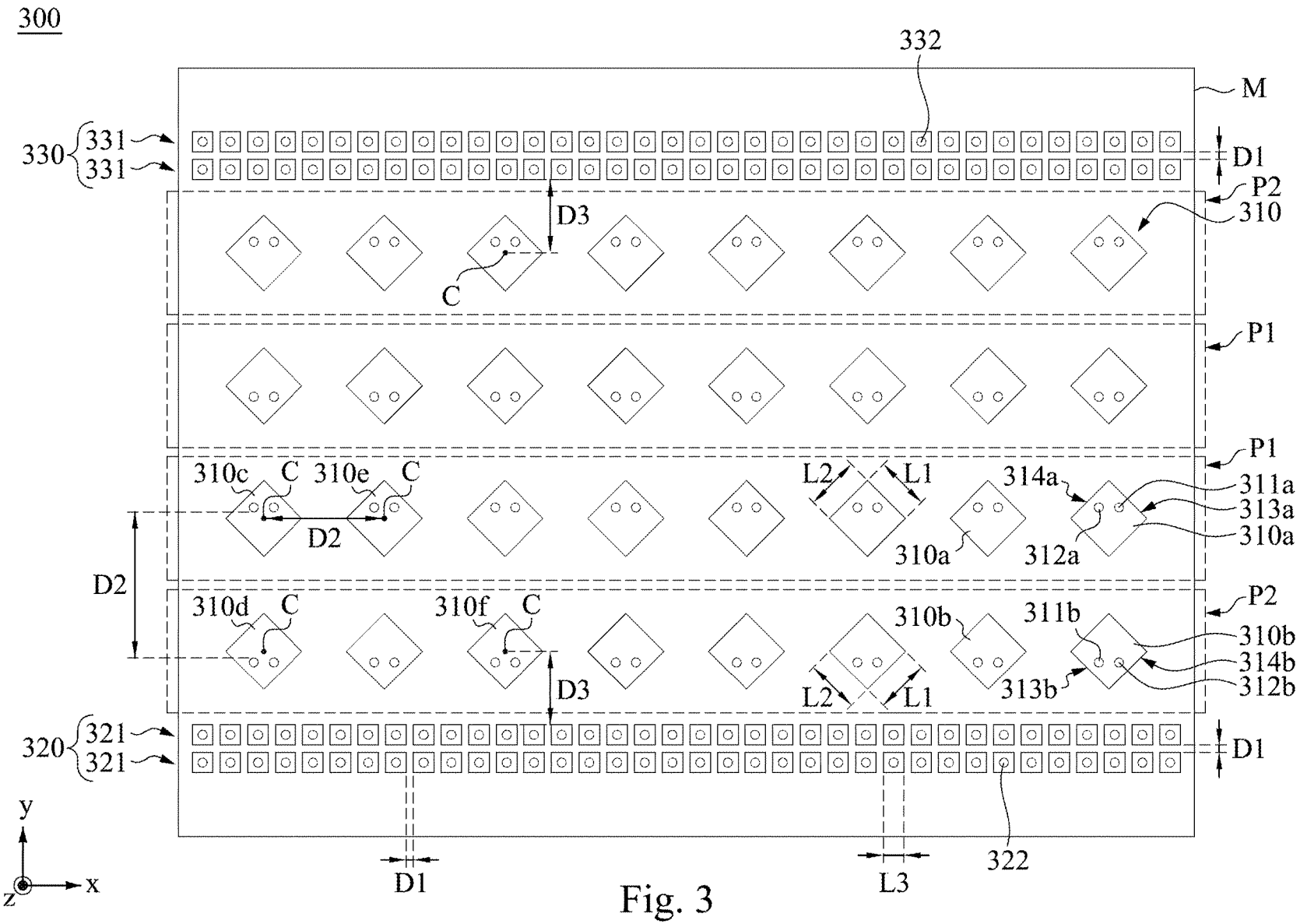
FIG. 3 is a schematic diagram of a dual polarized antenna according to an embodiment of the present disclosure.

FIG. 3 is a schematic diagram of a dual polarized antenna according to an embodiment of the present disclosure, in which FIG. 3 is a top view diagram on the x-y plane.

The dual polarized antenna 300 includes an antenna array 310, a first isolated band gap 320, and a second isolated band gap 330. The antenna array 310, the first isolated band gap 320, and the second isolated band gap 330 are all formed on the dielectric board M, and the antenna array 310 is disposed between to the first isolated band gap 320 and the second isolated band gap 330 adjacently.

The antenna array 310 includes a plurality of antenna units (for example, the antenna units 310*a*, 310*b*, 310*c*, 310*d*, 310*e*, and 310*f* shown in FIG. 3, which are not individually shown in the figure). In some embodiments, each antenna unit is similar to the antenna unit shown in FIG. 1 or FIG. 2, and the same points are not described here. A number of antenna units is only for illustration, and is not limited here.

In some embodiments, the antenna array 310 may be divided into at least one first group and at least one second group, and the first group and the second group respectively include a plurality of antenna units. For example, in FIG. 3, the antenna array 310 includes two first groups P1 and two second groups P2, and on the x-y plane, the first groups P1 and the second groups P2 are alternately arranged relative to the Y-axis direction.

In some embodiments, on the x-y plane, with the first isolated band gap 320 or the second isolated band gap 330 as the reference, for the position of the feed point in each antenna unit relative to this antenna unit, the first feed point and the second feed point of the antenna unit in the first group are farther away from the first isolated band gap 320 or the second isolated band gap 330, and the first feed point and the second feed point of the antenna unit in the second group are closer to the first isolated band gap 320 or the second isolated band gap 330. For example, in FIG. 3, on the x-y plane, with the first isolated band gap 320 as the reference, for the antenna unit 310*a* in the first groups P1, the first feed point 311*a* and the second feed point 312*a* are disposed adjacent to the first edge 313*a* and the second edge 314*a* respectively. Therefore, for this antenna unit 310*a*, relative to the distance from the first isolated band gap 320, the first feed point 311*a* and the second feed point 312*a* are farther away from the first isolated band gap 320. Similarly, for the antenna unit 310*b* in the second groups P2, the first feeding point 311*b* and the second feeding point 312*b* are disposed adjacent to the first edge 313*b* and the second edge 314*b* respectively. Therefore, for this antenna unit 310*b*, relative to the distance from the first isolated band gap 320, the first feed point 311*b* and the second feed point 312*b* are closer to the first isolated band gap.

On the x-y plane, the distance between any two adjacent antenna units, for example, as shown in FIG. 3, the distance between a center point C of the antenna unit 310*c* in the first groups P1 and the center point C of the adjacent one antenna unit 310*d* or the center point C of the antenna unit 310*e* is the same distance D2.

On the x-y plane, a minimum distance (for example, as shown in FIG. 3, a distance D3 between the center point C of the antenna unit 310*f* in the second groups P2 and the first isolated band gap 320) between a center point of the antenna unit and the first isolated band gap 320 or the second isolated band gap 330 is approximately in a range of 0.3 to 0.5 times the wavelength of the operating frequency of the antenna unit, i.e. $3\lambda/10 \leq$ distance D3 $\leq \lambda/2$, in order to achieve a good isolation effect. In some embodiments, the minimum distance between the center point of the antenna unit and the first isolated band gap 320 or the second isolated band gap 330 is approximately 0.4 times the wavelength of the operating frequency of the antenna unit, i.e. $2\lambda/5$, in order to achieve better isolation effect.

The first isolated band gap 320 includes a pair of isolated structures 321, i.e. two isolated structures 321, and each isolated structure 321 includes a plurality of isolated units 322. The second isolated band gap 330 also includes a pair of isolated structures 331, i.e. two isolated structures 331, and each isolated structure 331 includes a plurality of isolated units 332. The first isolated band gap 320 and the second isolated band gap 330 are similar to the isolated band gap shown in FIG. 1 or FIG. 2, and the same points are not described here.

In the embodiment shown in FIG. 3, in addition to the effect of the dual polarized antenna in the foregoing embodiment, the dual polarized antenna 300 of the embodiment further provides or enhances some advantages. For example, since the dual polarized antenna 300 includes an antenna array 310 with a plurality of antenna units, the dual polarized antenna 300 has good directivity and a high signal transmission distance. Since the dual polarized antenna 300 includes the first isolated band gap 320 and the second isolated band gap 330, the dual polarized antenna 300 has high isolation.

Figure 4:
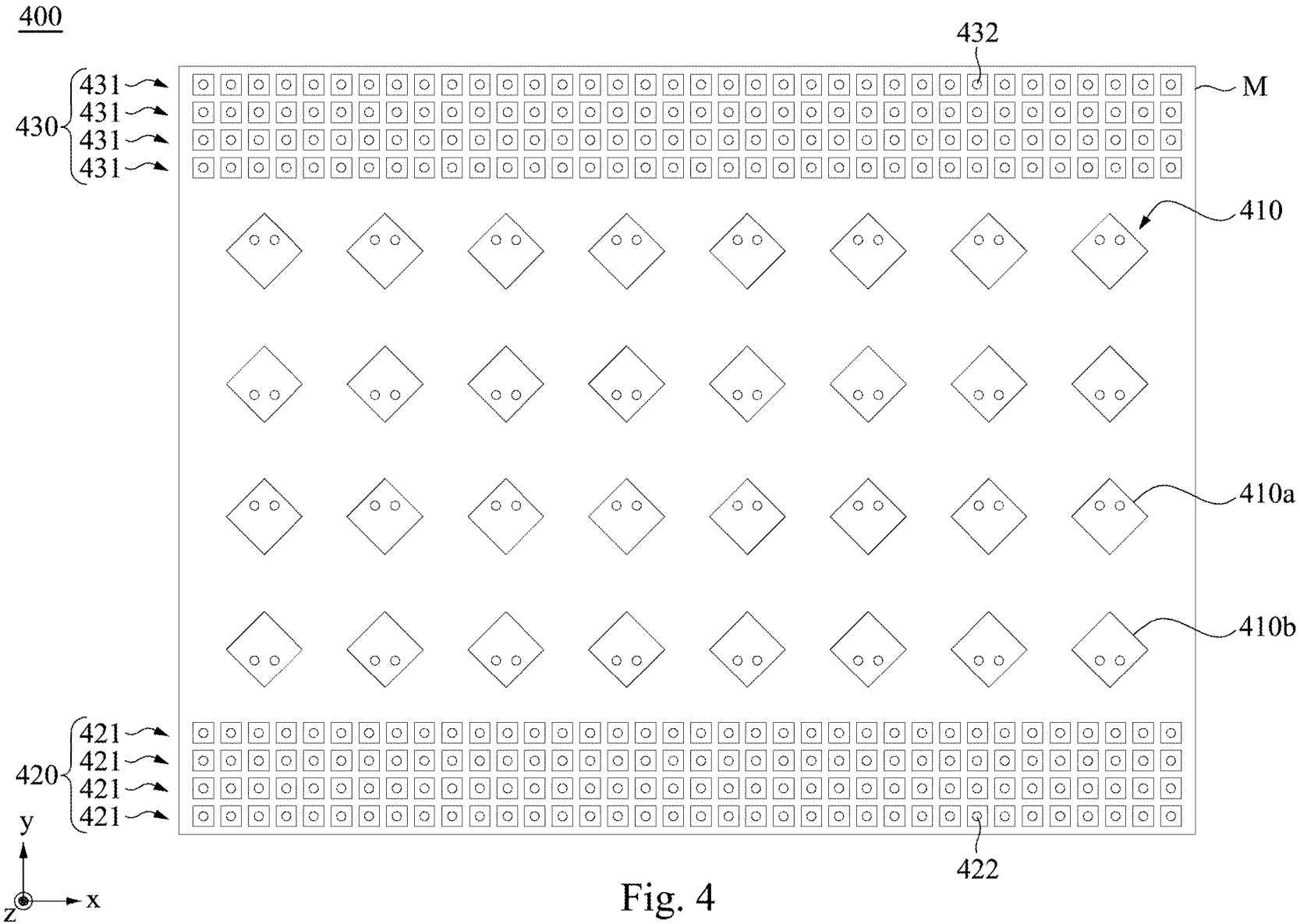
FIG. 4 is a schematic diagram of a dual polarized antenna according to an embodiment of the present disclosure.

FIG. 4 is a schematic diagram of a dual polarized antenna according to an embodiment of the present disclosure, in which FIG. 4 is a top view diagram on the x-y plane.

The dual polarized antenna 400 includes an antenna array 410, a first isolated band gap 420, and a second isolated band gap 430. The antenna array 410, the first isolated band gap 420, and the second isolated band gap 430 are all formed on the dielectric board M, and the antenna array 410 is disposed between the first isolated band gap 420 and the second isolated band gap 430 adjacently. The antenna array 410 includes a plurality of antenna units (for example, the antenna units 410*a* and 410*b* shown in FIG. 4 are not individually shown in the figure). The dual polarized antenna 400 shown in FIG. 4 is similar to the dual polarized antenna 300 shown in FIG. 3, and the same points are not described here.

The first isolated band gap 420 includes two pairs of isolated structures 421, i.e. four isolated structures 421, and each isolated structure 421 includes a plurality of isolated units 422. The second isolated band gap 430 includes two pairs of isolated structures 431, i.e. four isolated structures 431, and each isolated structure 421 includes a plurality of isolated units 432. The first isolated band gap 420 and the second isolated band gap 430 are similar to the isolated band gap shown in one of FIG. 1, FIG. 2, or FIG. 3, and the same points are not described here.

In the embodiment shown in FIG. 4, the dual polarized antenna 400 of this embodiment also has good directivity, high isolation, and long signal transmission distance.

In some embodiments, according to the dual polarized antennas 300 and 400 shown in FIGS. 3 and 4, an operating frequency of 28 GHz is implemented to simulate the application of 5G. At the same time, according to the dual polarized antenna 300 shown in FIG. 3, the first isolated band gap 320 and the second isolated band gap 330 in FIG. 3 are removed to form a dual polarized antenna (without isolated band gap) of a control group, and achieve a 28 GHz operating frequency with this dual polarized antenna. Table 1 uses 28 GHz as the operating frequency and the FtB ratio of the radiation pattern of the dual polarized antenna in the foregoing various embodiments.

TABLE 1

| dual polarized antenna | front-to-back ratio (dB) |
|---|---|
| control group (without isolated band gap) | 24 |
| FIG. 3 (with a pair of isolated structures) | 27.1 |
| FIG. 4 (with two pairs of isolated structures) | 43.6 |

As shown in Table 1, the FtB ratio of the radiation pattern of the control group is relatively lowest. The FtB ratio of radiation pattern of a dual polarized antenna (for example, the dual polarized antenna 300 of FIG. 3) with an isolated band gap comprising a pair of isolated structures or a dual polarized antenna (for example, the dual polarized antenna 400 in FIG. 4) with an isolated band gap comprising more than two pairs of isolated structures is greater than the FtB ratio of radiation pattern of the control group. Therefore, the dual polarized antenna proposed in the present disclosure can be applied to 5G technology and is an application with high isolation and directivity.

Figure 5:
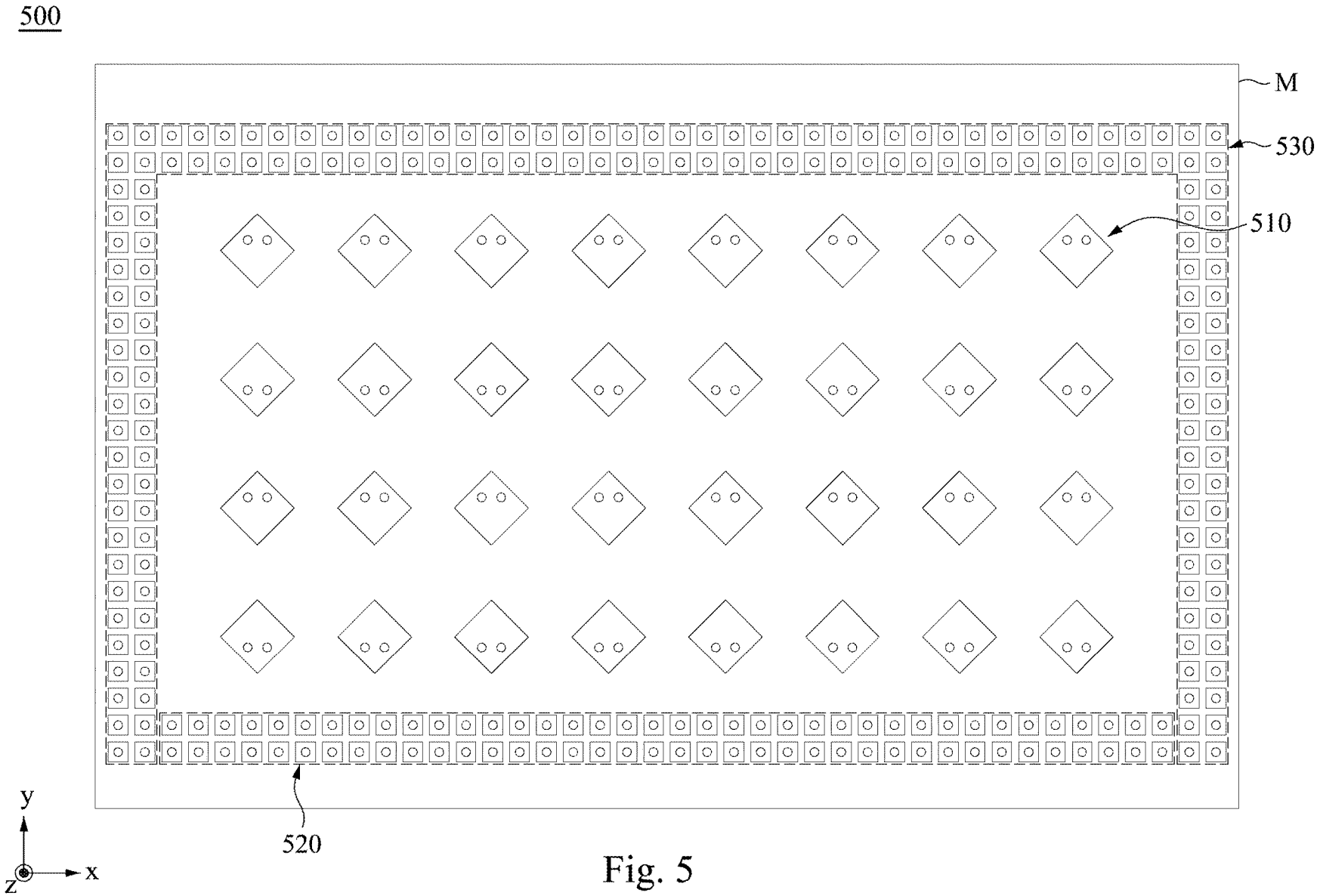
FIG. 5 is a schematic diagram of a dual polarized antenna according to an embodiment of the present disclosure.

FIG. 5 is a schematic diagram of a dual polarized antenna according to an embodiment of the present disclosure, in which FIG. 5 is a top view diagram on the x-y plane. The dual polarized antenna 500 shown in FIG. 5 is similar to the dual polarized antenna 300 shown in FIG. 3, and the same points are not described here.

On the x-y plane, a second isolated band gap 530 has an inverted U shape, and forms a closed hollow rectangle with the first isolated band gap 520. The antenna array 510 is disposed between the first isolated band gap 520 and the second isolated band gap 530. Or it can be understood that, on the x-y plane, the antenna array 510 is surrounded by the first isolated band gap 520 and the second isolated band gap 530.

Figure 6:
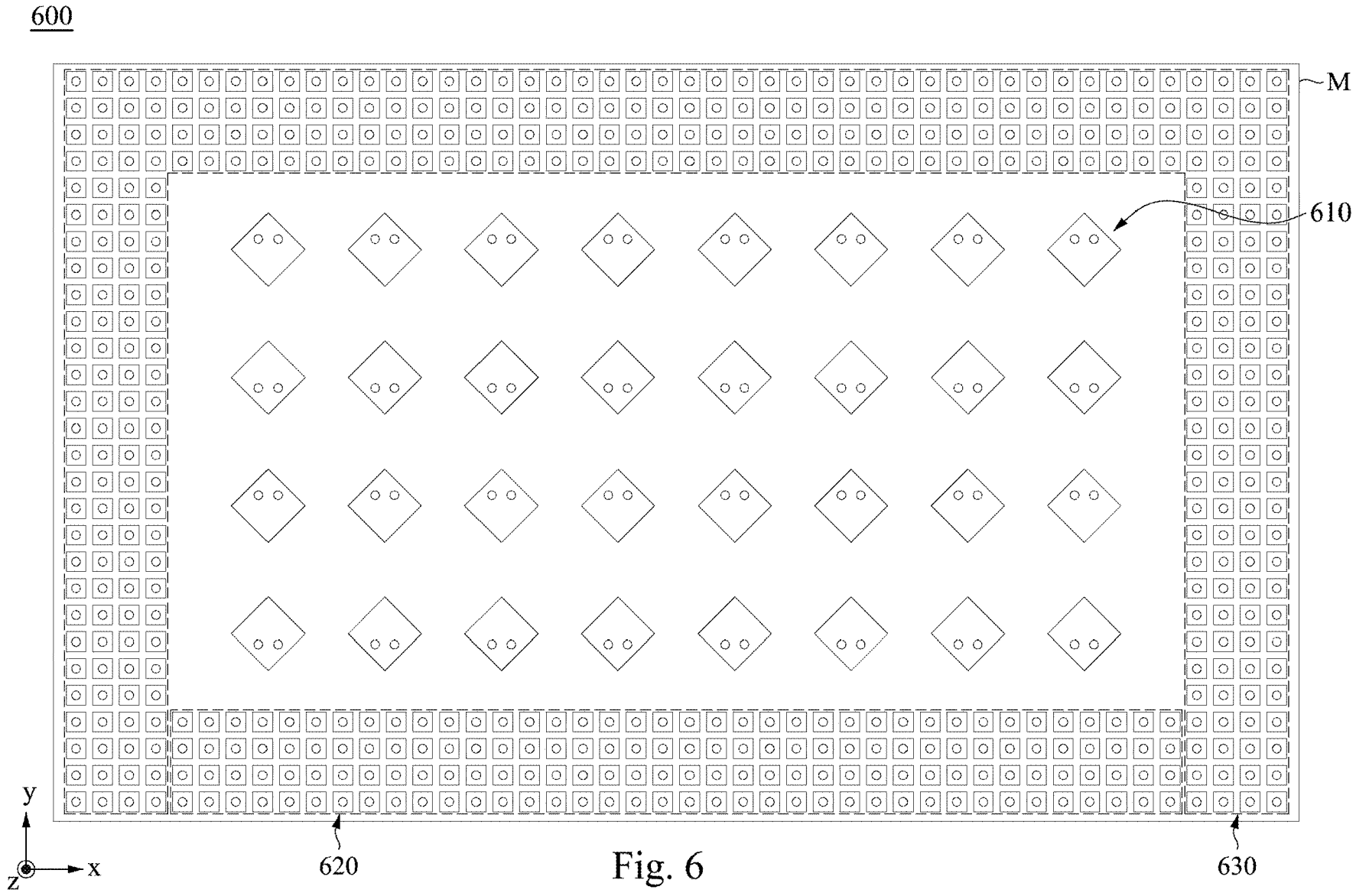
FIG. 6 is a schematic diagram of a dual polarized antenna according to an embodiment of the present disclosure.

FIG. 6 is a schematic diagram of a dual polarized antenna according to an embodiment of the present disclosure, in which FIG. 6 is a top view diagram on the x-y plane. The dual polarized antenna 600 shown in FIG. 6 is similar to the dual polarized antenna 400 shown in FIG. 4 and the dual polarized antenna 500 shown in FIG. 5, and the same points are not described here.

The first isolated band gap 620 and the second isolated band gap 630 respectively include two pairs of isolated structures (not shown in FIG. 6), i.e. four isolated structures. On the x-y plane, the antenna array 610 is surrounded by the first isolated band gap 620 and the second isolated band gap 630.

In the embodiment shown in FIG. 5 or FIG. 6, in addition to the effects of the dual polarized antenna in the foregoing embodiments, the dual polarized antenna in the embodiments further provides or enhances some advantages. For example, the arrangement of the first isolated band gap and the second isolated band gap around the antenna array can further improve the isolation of the dual polarized antenna.

Figure 7:
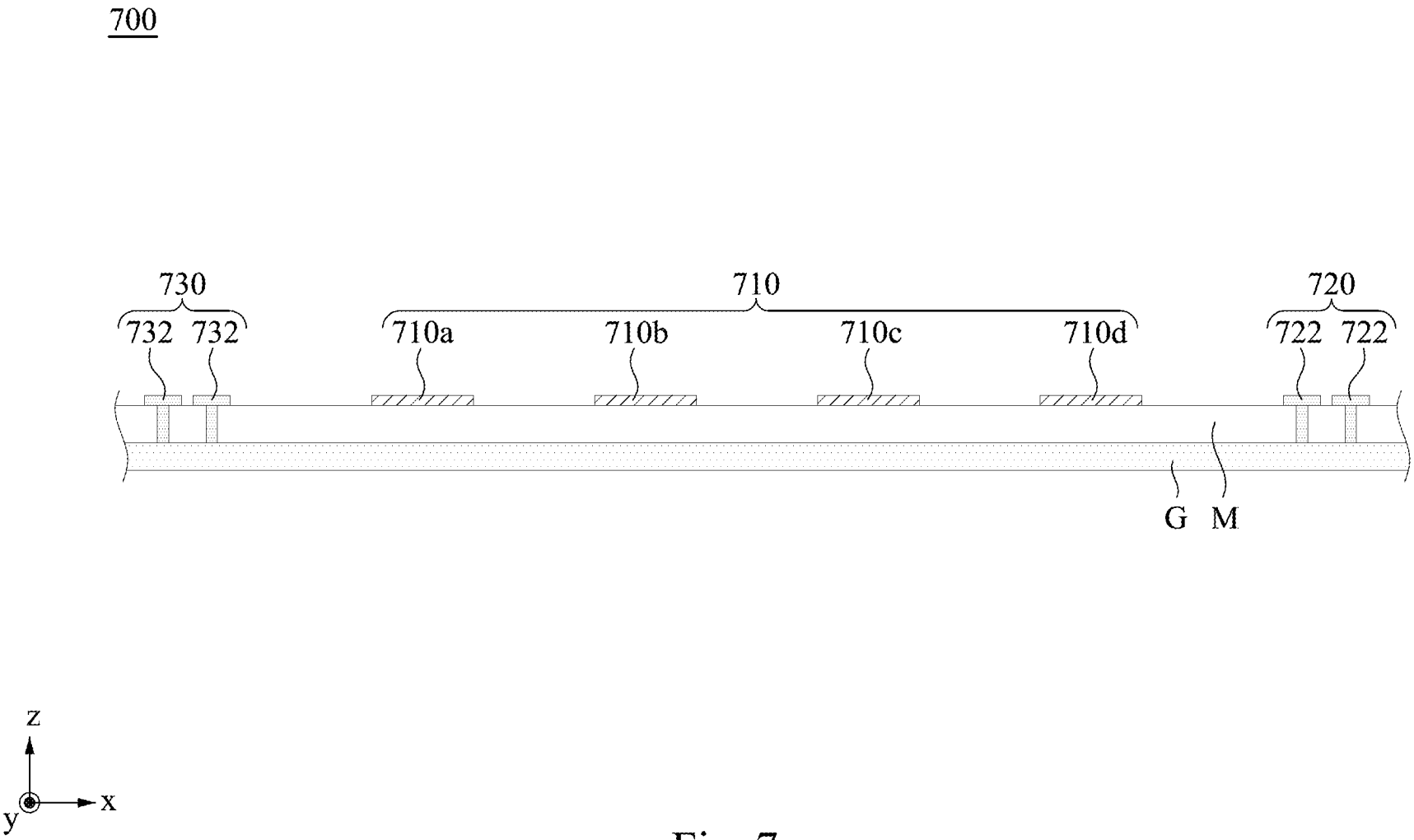
FIG. 7 is a schematic diagram of partial cross-sectional view of a dual polarized antenna according to an embodiment of the present disclosure.

FIG. 7 is a schematic partial cross-sectional view of a dual polarized antenna 700 according to an embodiment of the present disclosure, in which FIG. 7 is a top view diagram on the x-z plane. The dual polarized antenna 700 shown in FIG. 7 is similar to the dual polarized antenna 300 shown in FIG. 3, the dual polarized antenna 400 shown in FIG. 4, the dual polarized antenna 500 shown in FIG. 5 and the dual polarized antenna 600 shown in FIG. 6, and the Y direction of any one shown in FIGS. 3 to 6 is used as a cross-sectional line to draw a partially dual polarized antenna 700 on the x-z plane.

The dual polarized antenna 700 includes an antenna array 710, a first isolated band gap 720, and a second isolated band gap 730. The antenna array 710, the first isolated band gap 720, and the second isolated band gap 730 are all formed on the dielectric board M, and the dielectric board M is disposed on the ground plane G.

In some embodiments, the dielectric constant of the dielectric board M is in a range of 2 to 6. The dielectric constant of the dielectric board M is related to the operating wavelength of the dual polarized antenna 700 and a size of each unit in the dual polarized antenna 700 and the relative arrangement therebetween.

The antenna array 710 is disposed between the first isolated band gap 720 and the second isolated band gap 730 adjacently. The antenna array 710 includes a plurality of antenna units 710*a*, 710*b*, 710*c*, and 710*d*. In some embodiments, each antenna unit is similar to the antenna unit shown in any one of FIG. 1 to FIG. 6, and the same points are not described here. A number of antenna units is only for illustration, and is not limited here.

The first isolated band gap 720 includes a plurality of isolated units 722. The first isolated band gap 720 is similar to the isolated band gap shown in any one of FIGS. 1 to 6, and the isolated unit 722 is similar to the isolated unit shown in any one of FIGS. 1 to 6, and the same points are not described here. A number of isolated units 722 is only for illustration, and is not limited here.

The second isolated band gap 730 includes a plurality of isolated units 732. The second isolated band gap 730 is similar to the isolated band gap shown in any one of FIGS. 1 to 6, and the isolated unit 732 is similar to the isolated unit shown in any one of FIGS. 1 to 6, and the same points are not described here. A number of isolated units 732 is only for illustration, and is not limited here.

In some embodiments, the isolated unit 722 and the isolated unit 732 have the same structure, and have the same arrangement relative to the antenna array 710 respectively.

Figure 8:
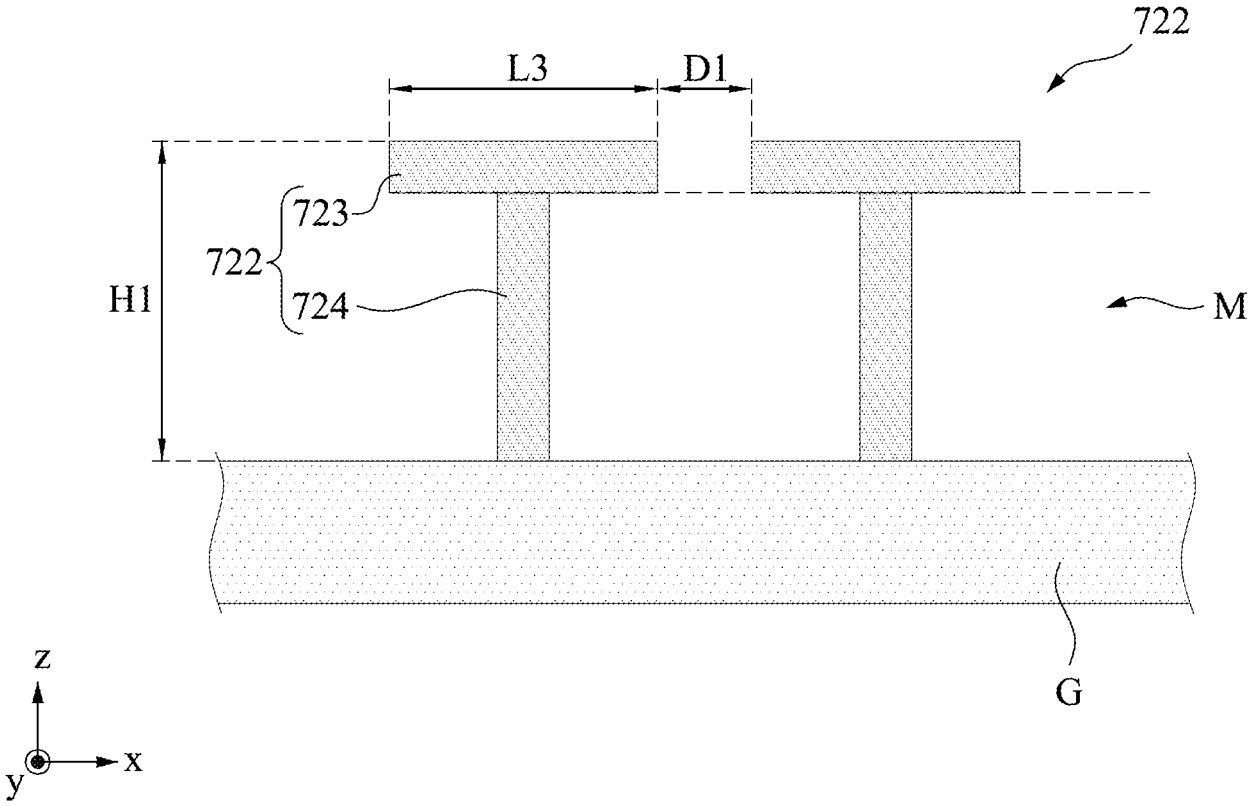
FIG. 8 is a schematic diagram of partial cross-sectional view of the dual polarized antenna according to FIG. 7.

FIG. 8 is a schematic partial cross-sectional view of the isolated unit 722 in the dual polarized antenna according to FIG. 7, in which FIG. 8 is a top view diagram on the x-z plane.

The isolated unit 722 includes a top metal sheet 723 and a connection metal via 724. In some embodiments, the isolated unit 722 is mushroom-shaped.

The top metal sheet 723 is formed on the dielectric board M, and is coupled to the connecting connection metal via 724.

In some embodiments, the top metal sheet 723 is a small square, and is substantially parallel to the ground plane G. In some embodiments, the top metal sheet 723 has a regular three-miniature shape, a circular shape, an oval shape, or a trapezoid shape, and the shape of the top metal sheet 723 is not limited herein.

The connection metal via 724 is formed in the dielectric board M, and is coupled to the ground plane G via the connection metal via 724.

In some embodiments, the connection metal via 724 is cylindrical and is substantially perpendicular to the ground plane G and the top metal sheet 723. In some embodiments, the connection metal via 724 is triangular via or square via, and the shape of the connection metal via 724 is not limited herein.

A length (for example, the length L3 of the side length shown in FIG. 8) of the maximum side length of the isolated unit 722 is less than 0.1 times a wavelength of an operating frequency of the dual polarized antenna 700, i.e. $\lambda/10$. A distance (for example, the interval distance D1 shown in FIG. 8) of the isolated interval between the isolated units 722 is less than 0.02 times the wavelength of the operating frequency of the dual polarized antenna 700, i.e. $\lambda/50$. A height (for example, the height H1 shown in FIG. 8 comprising the distance from the top surface of the top metal sheet 723 to the bottom end of the connection metal via 724) of the isolated unit 722 is less than 0.1 times the wavelength of the operating frequency of the dual polarized antenna 700, i.e. $\lambda/10$.

In summary, the dual polarized antenna proposed in the present disclosure can be applied to applications with high isolation and directivity. When the dual polarized antenna is working, because the included angle between each polarized direction and the isolated band gap is neither 0° nor 90°, signals with different polarized directions will not be blocked by the isolated band gap and thus can be transmitted to another signal processing end. At the same time, the dual polarized antenna can block other noise through the isolated band gap, so the dual polarized antenna has good signal isolation.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A dual polarized antenna, comprising:

a first antenna unit formed on a dielectric board, wherein the first antenna unit being fed is configured to receive or transmit a signal with each of a first polarization direction and a second polarization direction, wherein the first antenna unit is a patch antenna, wherein the first antenna unit comprises:

a first feed point configured to receive or transmit the signal with the first polarization direction; and a second feed point configured to receive or transmit the signal with the second polarization direction;

a second antenna unit, formed on the dielectric board, and the second antenna unit being fed is configured to receive or transmit a signal with each of the first polarization direction and the second polarization direction; and an electromagnetic bandgap structure formed on the dielectric board and disposed adjacent to the first antenna unit, wherein a first included angle which is neither 0° nor 90° is formed between the first polarization direction and an arrangement direction of the electromagnetic bandgap structure, wherein a shortest distance between a center point of the first antenna unit and the electromagnetic bandgap structure is equal to a shortest distance between a center point of the second antenna unit and the electromagnetic bandgap structure.

2. The dual polarized antenna of claim 1, wherein a second included angle which is neither 0° nor 90° is formed between the second polarization direction and the electromagnetic bandgap structure.

3. The dual polarized antenna of claim 1, wherein the first feed point is disposed adjacent to a first edge of the first antenna unit, the second feed point is disposed adjacent to a second edge of the first antenna unit which is adjacent to the first edge, and a center point of the first edge and a center point of the second edge are respectively equidistant from the electromagnetic bandgap structure.

4. The dual polarized antenna of claim 3, wherein lengths of the first edge and the second edge are respectively approximately equal to 0.25 times a wavelength of an operating frequency of the first antenna unit.

5. The dual polarized antenna of claim 1, wherein a distance between a center point of the first antenna unit and the electromagnetic bandgap structure is in a range of 0.3 to 0.5 times a wavelength of an operating frequency of the first antenna unit.

6. The dual polarized antenna of claim 1, wherein the electromagnetic bandgap structure comprises:

a plurality of isolated structures, wherein the plurality of isolated structures are adjacent to each other.

7. The dual polarized antenna of claim 6, wherein each of the plurality of isolated structures is a strip metal structure, and a number of the plurality of isolated structures is an even number.

8. The dual polarized antenna of claim 7, wherein each of the plurality of isolated structures comprises:

a plurality of isolated units, wherein the plurality of isolated units are disposed adjacent to each other, and an isolated interval between adjacent two of the plurality of isolated units is less than 0.02 times a wavelength of an operating frequency of the first antenna unit.

9. The dual polarized antenna of claim 8, wherein a maximum side length or a height of each of the plurality of isolated units is less than 0.1 times the wavelength of the operating frequency of the first antenna unit.

10. The dual polarized antenna of claim 8, wherein each of the plurality of isolated units comprises:

a connection metal via; and a top metal sheet coupled to a ground plane via the connection metal via.

11. The dual polarized antenna of claim 1, further comprising:

wherein the electromagnetic bandgap structure is disposed between the first antenna unit and the second antenna unit, and the first antenna unit and the second antenna unit are symmetrical with the electromagnetic bandgap structure as an axis of symmetry.

12. The dual polarized antenna of claim 1, wherein the first included angle is in a range of 40° to 50°.

13. A dual polarized antenna, comprising:

an antenna array formed on a dielectric board, and the antenna array being fed is configured to receive or transmit a signal with one of a first polarization direction or a second polarization direction, wherein the antenna array is divided into at least one first group and at least one one second group, the at least one first group and the at least one second group respectively have a plurality of antenna units, and the plurality of antenna units are a plurality of patch antennas, wherein each of the plurality of antenna units comprises:

a first feed point configured to receive or transmit the signal with the first polarization direction; and a second feed point configured to receive or transmit the signal with the second polarization direction;

a first electromagnetic bandgap structure formed on the dielectric board and disposed adjacent to the antenna array, and a second electromagnetic bandgap structure formed on the dielectric board and disposed outside the antenna array, wherein the antenna array is disposed between the first electromagnetic bandgap structure and the second electromagnetic bandgap structure, wherein an included angle which is neither 0° nor 90° is formed between the first polarization direction and an arrangement direction of the first electromagnetic bandgap structure, wherein shortest distances between a center point of each of the plurality of antenna units of the at least one first group and the first electromagnetic bandgap structure are equal, and shortest distances between a center point of each of the plurality of antenna units of the at least one second group and the first electromagnetic bandgap structure are equal.

14. The dual polarized antenna of claim 13, wherein the second polarization direction is orthogonal to the first polarization direction, and the included angle is formed between the second polarization direction and the first electromagnetic bandgap structure.

15. The dual polarized antenna of claim 13, wherein the first feed point is disposed adjacent to a first edge of each of the plurality of antenna units, the second feed point is disposed adjacent to a second edge of each of the plurality of antenna units which is adjacent to the first edge, and a center point of the first edge and a center point of the second edge are respectively equidistant from the first electromagnetic bandgap structure.

16. The dual polarized antenna of claim 15, wherein, for each of the plurality of antenna units, relative to a distance from the first electromagnetic bandgap structure, the first feed point and the second feed point of each of the plurality of antenna units of the at least one first group are farther away from the first electromagnetic bandgap structure, and the first feed point and the second feed point of each of the plurality of antenna units of the at least one second group are closer to the first electromagnetic bandgap structure.

17. The dual polarized antenna of claim 15, wherein lengths of the first edge and the second edge are each approximately equal to 0.25 times a wavelength of an operating frequency of the antenna units.

18. The dual polarized antenna of claim 15, wherein a minimum distance between center points of the antenna units and the first electromagnetic bandgap structure is in a range of 0.3 to 0.5 times a wavelength of an operating frequency of the antenna units.

19. The dual polarized antenna of claim 15, wherein an interval between adjacent two of the plurality of antenna units is approximately equal to 0.5 times a wavelength of an operating frequency of the antenna units.

* * * * *